US008021066B2

(12) United States Patent
Thiebaut

(10) Patent No.: US 8,021,066 B2
(45) Date of Patent: Sep. 20, 2011

(54) DEVICE FOR PACKAGING AND APPLYING A COSMETIC OR CARE PRODUCT HAVING A ROTATING COMPONENT AND CORRESPONDING APPLICATION METHOD

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 873 days.

(21) Appl. No.: 11/688,828

(22) Filed: Mar. 20, 2007

(65) Prior Publication Data

US 2007/0231050 A1 Oct. 4, 2007

Related U.S. Application Data

(60) Provisional application No. 60/788,101, filed on Apr. 3, 2006.

(30) Foreign Application Priority Data

Mar. 20, 2006 (FR) ..... 06 02412

(51) Int. Cl.
*A46B 11/00* (2006.01)

(52) U.S. Cl. ..... 401/130; 401/121; 401/126

(58) Field of Classification Search ..... 401/121, 401/122, 126, 127, 130, 219, 220, 208, 209
See application file for complete search history.

(56) References Cited

U.S. PATENT DOCUMENTS

| | | | | |
|---|---|---|---|---|
| 2,778,050 | A | 1/1957 | Meinhardt | |
| 5,064,058 | A * | 11/1991 | Hirzel | 206/209 |
| 5,473,791 | A | 12/1995 | Holcomb et al. | |
| 5,727,708 | A * | 3/1998 | Erickson | 220/23.87 |
| 7,523,518 | B2 * | 4/2009 | Futo et al. | 15/230.11 |
| 2006/0056905 | A1 | 3/2006 | Thiebaut | |
| 2007/0017543 | A1 | 1/2007 | Thiebaut | |

FOREIGN PATENT DOCUMENTS

| | | |
|---|---|---|
| DE | 203 10 777 U | 2/2004 |
| EP | 1 454 562 | 9/2004 |
| FR | 2848790 | 6/2004 |
| WO | WO 98/23183 | 6/1998 |
| WO | WO 99/53797 | 10/1999 |

OTHER PUBLICATIONS

U.S. Appl. No. 12/197,010, Aug. 22, 2008, Thiebaut.

* cited by examiner

*Primary Examiner* — David Walczak
(74) *Attorney, Agent, or Firm* — Oblon, Spivak, McClelland, Maier & Neustadt, L.L.P.

(57) ABSTRACT

A device for packaging and applying a product. According to an advantageous example, the device includes a container for storing the product, a product applicator including a rotating component capable of being inserted into the container in order to be loaded with product and capable of applying the product removed onto an application surface. The device further includes a member for capping the container that bears the applicator and an applicator wiping member. The wiping member can include, for example, a flat surface against which the rotating component rolls along. The invention can be particularly advantageous, for example, in packaging and applying a cosmetic or care product.

22 Claims, 8 Drawing Sheets

DEVICE FOR PACKAGING AND APPLYING A COSMETIC OR CARE PRODUCT HAVING A ROTATING COMPONENT AND CORRESPONDING APPLICATION METHOD

CROSS-REFERENCE TO RELATED APPLICATIONS

This document claims priority to French Application Number 06 02412, filed Mar. 20, 2006 and U.S. Provisional Application No. 60/788,101, filed Apr. 3, 2006, the entire contents of which are hereby incorporated by reference.

BACKGROUND OF THE INVENTION

1. Field of the Invention

The invention relates to devices for packaging and dispensing products, in particular fluid products.

2. Discussion of Background

More particularly, the invention relates to a device for packaging and applying a cosmetic or care product, that is to say a product as defined in the Council Directive 93/35/EEC of 14 Jun. 1993.

A particularly advantageous application of the invention relates to packaging and applying a liquid makeup formula, such as a lip gloss, mascara, nail varnish etc.

Products of this type are generally kept in a storage container equipped with a capping member which seals an open end of the container in order to keep the product airtight.

The product is applied using an applicator mounted on the end of a wand borne by the capping member so that when the container is closed, the applicator is immersed in the container, in contact with the product.

The applicators are often produced in comb or brush form, the application then being carried out by sliding the applicator, loaded with product, over an application surface.

The layer formed using this type of applicator may sometimes have grooves formed by the movement of the applicator relative to the application surface, during application of the product. Moreover, when the applicator is passed over the same place again in order to perfect the makeup, there is a tendency to wipe off the product deposited during the first application.

In order to alleviate this drawback, it has been proposed to equip the devices for packaging and applying products with an applicator comprising a rotating component, of the roller type, mounted rotationally on a wand borne by the member for capping the container.

This solution is advantageous in so far as it enables a more homogeneous deposition of the product to be obtained.

In this respect, reference should be made to French patent No. 02 16 283 which describes a cosmetic product distributor equipped with a rotating applicator.

In any case, whatever type of applicator is used, the containers are generally equipped with a wiping member used to wipe the applicator when it is extracted from the container in order to remove the excess product before application.

The wiping member is generally produced in the form of a narrowing of cross section at the open end of the container. When the applicator is of the roller type, the wiping member has a diameter less than that of the applicator. When the applicator is asymmetrical, the wiping member is flexible so as to follow the shape of the applicator when the latter crosses it.

It is in this way that French patent No. 02 16 283 proposes to equip the open end of the container with a wiping collar against which the rotating component rubs when it is taken out of the container.

Document DE 203 10 777 also proposes to equip the open end of a container with an applicator wiping member against which the applicator is rubbed when it is taken out of the container.

The applicator is formed, in this embodiment, from a disc whose rotational axis is perpendicular to the axis of the container and of the wand on which it is mounted. This type of applicator is used to draw a fine line using the edge of the disc. The wiping member is produced in the form of a cylinder with a circular cross section whose diameter is about equal to the diameter of the disc.

These wiping members make it possible to remove the surplus product present on the applicator in order to only keep on the applicator the dose to be applied.

According to the techniques described in the aforementioned documents, the wiping of a roller applicator is carried out by wiping portions of the applicator in contact with the wiping member.

However, when the roller applicator is mounted transversely relative to the axis of the container, during the wiping only the areas of the applicator that rub against the wiping member are wiped, so that it is not possible to wipe the whole periphery of the applicator.

Thus, after wiping, the applicator is no longer uniformly loaded.

SUMMARY OF THE INVENTION

Hence, one object of the invention is to alleviate the drawbacks of the devices for packaging and applying a product according to the prior art which use a transversely-oriented product applicator and which are equipped with a rotating component that is wrung out by wiping before application.

One subject of the invention is therefore, according to a first aspect, to provide a device for packaging and applying a product which is particularly advantageous for a cosmetic or care product. According to an example of an embodiment, the device includes a container for storing the product, and a product applicator. The applicator includes a rotating component capable of being inserted into the container in order to be loaded with the product and capable of applying the product onto an application surface. The device further includes an applicator wiping member, and a member for capping the container that bears or holds the applicator.

According to a feature of an example of a device according to the invention, the wiping member includes a wiping surface against which the rotating component rolls along when it is moved in the container. Thus, when the applicator is taken out of the container, the rotating component rolls against the wiping member, preferably so that the whole peripheral surface of the applicator is wiped. After wiping, the applicator is uniformly loaded with product, which greatly facilitates the application of a homogeneous (or more homogeneous) layer of product.

According to another feature of an example of the invention, the container includes a body equipped with a closed end and an open end forming a neck, with the wiping member forming a wall extending from the neck in the direction of the closed end.

According to another feature of an example of the invention, the wiping surface extends in an overall direction parallel to a general axis of the container.

By way of example, the wiping wall may be connected to stiffening means or a stiffening arrangement. For example, the stiffening means or arrangement can be arranged in the form of two transverse walls extending respectively from two longitudinal edges of the wiping wall, perpendicular to the wall. The transverse walls can have a height that decreases regularly away from the wiping wall, for example. They may, in addition, be connected on the opposite side of the wiping wall.

In one embodiment, by way of example, the wiping surface is equipped with perforations.

According to another feature of an example of the invention, a collar is added or mounted to the open end of the container. The wiping member can then be molded with the collar. This collar can be equipped, for example, with snap-fastening means that interact with complementary snap-fastening means made in the container body.

According to another feature of an example of the invention, the capping member can be provided with snap-fastening means that interact with complementary snap-fastening means made in the neck of the container.

In one embodiment, the wiping member includes a support placed at a distance from the bottom of the container from which the wiping surface extends.

For example, the support can include a base resting against the bottom of the container, for example a base with three feet.

Advantageously, the support includes a plate which extends transversely in the container and which includes a cutout for access to the wiping surface.

The wiping surface may be articulated to the plate and rest against the bottom of the container, for example.

In one embodiment, by way of example, the wiping surface includes a first portion connected to the transverse plate via a first articulation and a second portion connected to the first portion via a second articulation and via which the wiping surface rests against the bottom of the container. In addition, the first portion can be perforated.

For the rotating component, in various envisaged embodiments, this is for example rotationally mounted on a mount borne or held by the capping member, for rotation about a rotational axis that is perpendicular to the general axis of the container, when it is inserted in the container.

According to yet another feature of the device according to an example of the invention, the rotating component includes a raised outer surface. When the application surface is a raised surface, only the product present on the raised sections is wiped while the product remains in the hollows of the rotating component, between the raised sections. It is then possible to make patterns on the surface to be treated, or even to deposit the product contained in the hollows onto the eyelashes and to use the raised sections to separate the eyelashes.

In addition, by way of example, the neck of the container can have a transverse cross section in the shape of a parallelogram, for example a rectangular or square parallelogram.

Another object of the invention, according to another aspect or feature, is a method for applying a product, especially a cosmetic or care product. According to an example, the method includes immersing an applicator, including a rotating component into a container filled with the product to be applied. The applicator is extracted from the container while wiping it, and then the product is applied onto an application surface by means of the wiped applicator.

According to a feature of an example of this application method, the wiping of the applicator is carried out by rotation of the rotating component against a wiping surface extending into the container. For example, the rotation of the rotating component against the wiping surface can be carried out around a rotational axis that is perpendicular to a general axis of the container.

As should be apparent, the invention can provide a number of advantageous features and benefits. It is to be understood that, in practicing the invention, an embodiment can be constructed to include one or more objects, features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as nonlimiting examples of the invention. In the drawings.

DETAILED DESCRIPTION OF THE PREFERRED EMBODIMENTS

Figure 1:
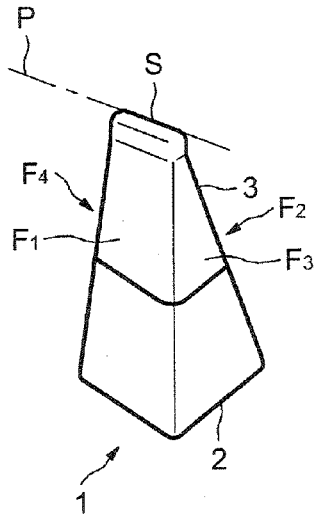
FIG. 1 is a perspective view of a device for packaging and applying a cosmetic product according to an example of the invention, in the closed state.
Figure 2:
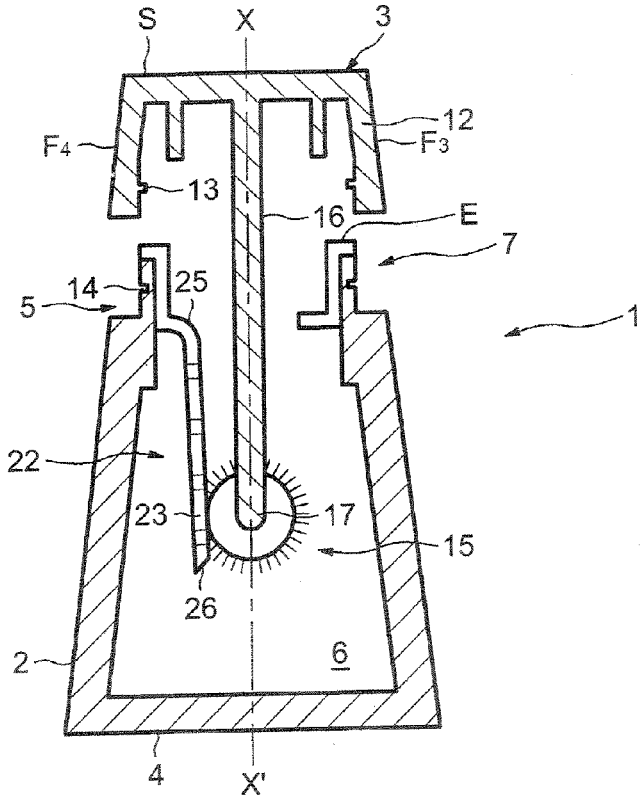
FIG. 2 is a schematic sagittal sectional view of a first embodiment of the device from FIG. 1 during extraction of the applicator.

In the example of FIGS. 1 and 2, a device for packaging and applying a cosmetic formula is represented, denoted by the general numerical reference 1. This device 1 has a plane of symmetry P and a longitudinal axis X-X' that are assumed to be vertical. In FIG. 2, the plane of symmetry of the device 1 is coincident with the plane of this figure. In the position represented in FIG. 1, the device 1 is represented in the closed state, whereas in the position visible in FIG. 2, the device is partially open.

As can be seen from FIGS. 1 and 2, the device 1 of this example includes a container 2 and a member 3 for capping the container which bears or holds an applicator 15 that is used to apply a product contained in the container.

In the example shown, the device 1 has a polyhedral shape with a quandrangular base. It has two rectangular faces F1 and F2 that are opposite each other and two triangular faces F3 and F4 that are opposite each other. The container 2 includes a body equipped with a sealed lower end 4 and an open opposite end 5 that forms a neck. Internally it defines a space 6 filled with a cosmetic formula, such as a lip gloss, a mascara, or a nail varnish. The upper open end 5 is provided with an added collar 7 which is provided with a wiping member 22 for the applicator 15. By way of example, the container 2, the capping member 3 and the collar 7 are each produced in one piece by molding a thermoplastic.

Figure 3:
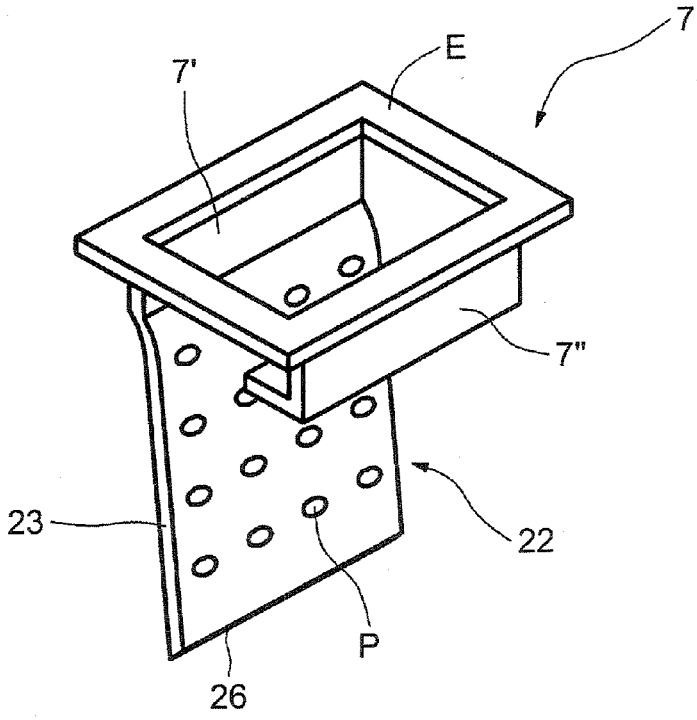
FIG. 3 is a detailed perspective view of an example of the wiping member.

With reference also to FIG. 3, the collar 7 essentially has a rectangular shape and forms a shoulder E of rectangular shape that is complementary to that of the edge of the upper end of the container 2 against which it rests.

The shoulder E extends, from the edge of the container via two sides, namely a first rectangular side 7', from which the wiping member 22 extends, and a second side 7" having an L-shaped cross section. The two sides 7' and 7" are spaced at a distance such that the collar is inserted into the neck 5 of the container. In order to improve the assembly, complementary snap-fasteners can be provided in the neck 5 and the collar 7. By way of example, such snap-fasteners or snap-fastening means can be provided by a rib and groove arrangement (e.g., as discussed below in connection with snap fastening of the lid or cap to the container).

As for the capping member 3, it has a capping lid 12 with a rectangular base. It comprises a skirt having two side faces F1 and F2, which are joined at the top S of the lid 12 to form a dihedron and the two triangular transverse faces F3 and F4 (FIG. 1). The lid 12 is assembled by snap-fastening to the neck of the container in this example. To that end, by way of example, the internal wall of the skirt of the lid 12 is provided with an internal peripheral rib 13 whereas the external peripheral surface of the neck 5 is provided with a peripheral groove 14 in which, on assembly, the rib 13 of the lid 12 is snap-fastened. Of course, it would also be possible, as a variation, to make the peripheral groove in the lid and to put the rib in the neck 5.

Figure 4:
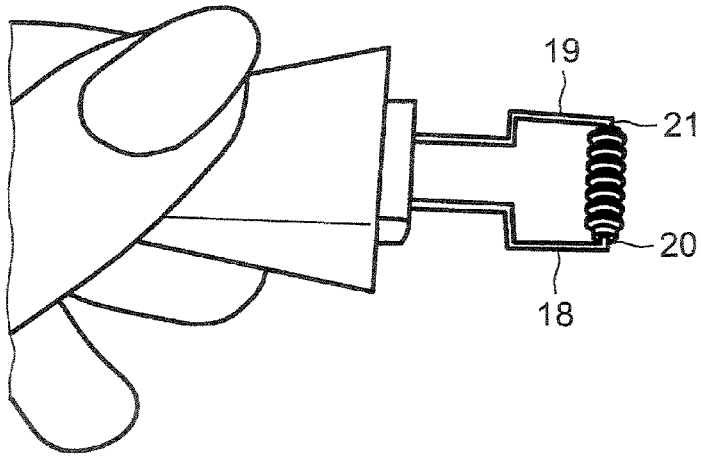
FIG. 4 is a view of the applicator in the process of being used.

As previously indicated, with reference to FIGS. 2 and 4, the capping member 3 is provided with an applicator 15. This applicator is borne or held by a mount 16 fixed to the lid 12. The mount 16 is in the form of a wand molded in one piece with the lid and extending parallel to the general axis X-X' of the container 2 when the capping member 3 is assembled on the neck of the container. The length of the wand 16 corresponds overall to that of the height of the container 2 so that, when the capping member 3 is assembled on the neck, the applicator 15 lies in the bottom of the container.

The applicator 15 is essentially formed from a rotating component. This rotating component is in the form of a cylindrical roller. It is rotationally mounted on the lower end 17 of the mount 16 about a rotational axis perpendicular to the general axis X-X' of the container 2 or, in other words, about a rotational axis perpendicular to the axis of the mount 16.

For example, in one advantageous embodiment, the mount 16 includes two wands 18 and 19 (FIG. 4) which extend from the lid 12 and which are provided with two respective coaxial ends 20 and 21, turned towards each other to form a rotational axis for the rotating component 15.

As for the cylindrical component 15, it is provided with a cylindrical core equipped with an axial passage or with two end holes (not shown) into which the ends 20 and 21 of the two wands 18 and 19 are inserted.

Figure 5:
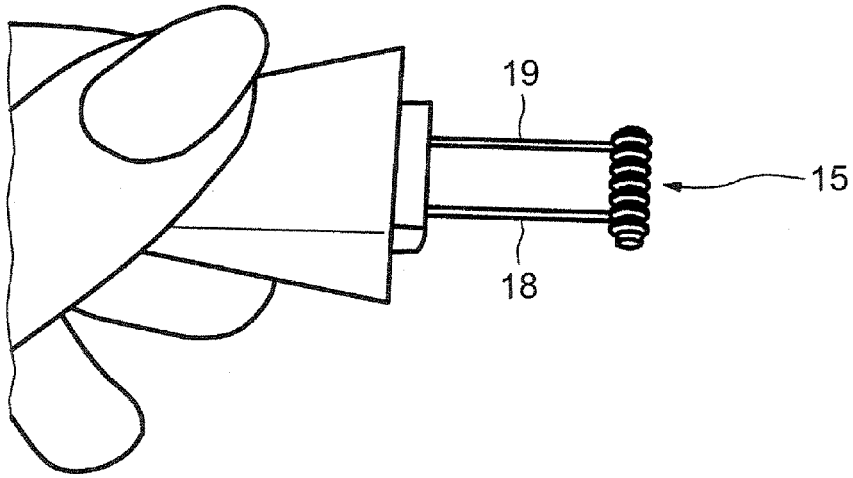
FIGS. 5 to 11 illustrate various embodiments of the applicator.

Of course, the mount may also adopt any other suitable shape for the envisaged use. For example, whereas in the embodiment example illustrated in FIG. 4, the mount can have two wands whose ends each form a male component intended to be inserted into the rotating component, as a variation, as shown in FIG. 5, the wands 18 and 19 can have a rectilinear shape. In this case, for example, the ends of the wands opposite each other form a hook which is fastened respectively onto a central part of the two ends of the rotating component 15 that are opposite each other by providing, for example, in the central part, an orifice capable of receiving the end of the hook.

Figure 6:
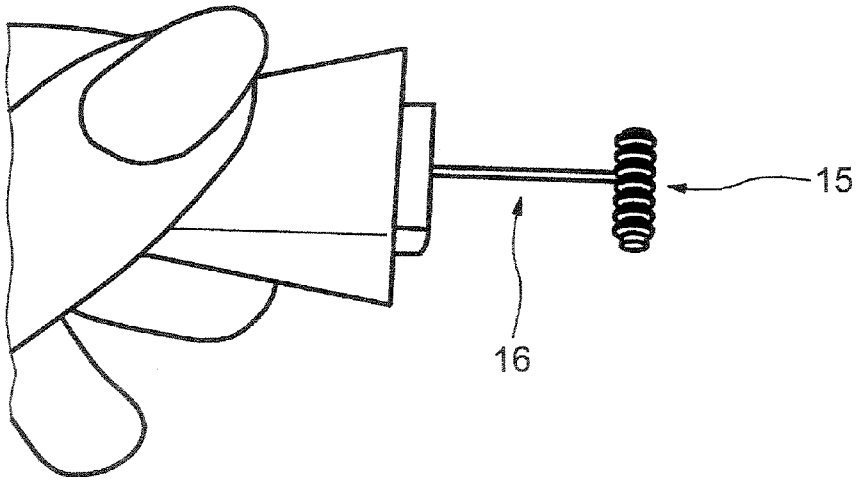
Figure 7:
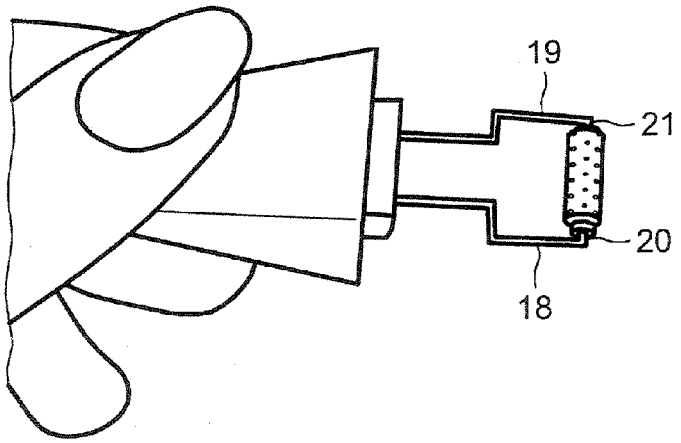

As a variation, for example, as illustrated in FIG. 6, the mount 16 can be produced in the form of a single central mounting bracket also provided with an end hook which is fastened to the central part of the rotating component 15. In this example, the rotating component 15 can be provided with a central narrowing of cross section defining an annular bearing surface in which a slot may be provided in which the end of the hook is inserted.

As previously indicated, the applicator 15 is intended to be positioned in the bottom of the container 2 between uses of the device, when the container is capped by the lid 12, so that between two applications, the applicator remains loaded with product. Thus, when it is desired to use the device, it is advisable to simply remove the lid and apply the rotating component 15 against a surface to which it is desired to be applied, for example skin, nails, or eyelashes.

The application is then carried out by rolling the applicator on the application surface. However, when the coefficient of friction between the applicator and the application surface is very low, the application may then be carried out by rubbing. Such is, in particular, the case when the applicator is intended to apply a product onto eyelashes.

However, as previously indicated, in order to remove the excess product present on the applicator 15, and in order that only the correct dose to be applied remains on this applicator, the device is equipped with a wiping member 22.

As shown by way of example in FIGS. 2 and 3, this wiping member can include a wall 23 which extends from the neck 5 in the direction of the bottom of the container, in the space 6. In the illustrated example, this wall 23 is molded in one piece with the collar 7. It forms a wiping surface that makes it possible to carry out wiping of the applicator 15 by rotation. As can be seen in FIG. 2, the wall 23 extends approximately parallel to the axis X-X' of the container 2 but while converging slightly towards this axis.

This wall 23 is, for example, molded in one piece with the body 8 of the collar 7. The wall in this example includes a bent proximal end 25, via which it extends from the collar 7, which extends in a rectilinear fashion towards the bottom of the container 2. The free end 26 of the wall 23 is chamfered so as to facilitate the removal of the rotating component 15 by avoiding forming a stop that blocks the exit of the applicator.

As can be seen in the example of FIG. 2, the wall 23 is out of line with the axis X-X' of the container by a distance approximately corresponding to the radius of the applicator 15. However, the free end 26 of the wall 23 is out of line with the axis X-X' by a distance slightly less than the radius of the applicator 15 so as to obtain an increased wiping, in this area, by increasing the pressure exerted by the applicator 15 on the wall 23 when the excess product is greater. Thus the wiping of the applicator will be facilitated by producing the first wiping surface 23 in the form of an elastically deformable tail. When the applicator is removed from the container, the rotating component 15 rolls against the wall 23 and is thus wiped by rotation. Preferably, as can be seen in FIG. 3, in order to facilitate the return of the product to the bottom of the container, a group of perforations P can be provided in the wall 23.

With the object of obtaining efficient wiping, the wall 23 will preferably be produced with a length corresponding at least to the periphery of the roller. Thus, when the applicator is completely removed from the container, the rotating component has been suitably wiped over its entire periphery and includes a dose of product to be applied that is regularly distributed over its entire outer surface.

It is to be understood that the invention also applies to applicators which may be provided with a rotating component of various shapes. It is thus possible to produce the rotating component in the shape of a cylindrical roller, as illustrated for example in FIGS. 7 to 11, but also with other shapes such as a conical, frustoconical or curved shape, depending on the area onto which the product is intended to be applied. It should however be noted that the wiping wall preferably retains a shape complementary to that of the rotating component.

The applicator may also be shaped in order to have a variable length and, as the case may be, a radius larger than its full length.

Figure 8:
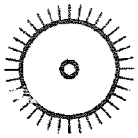
Figure 9:
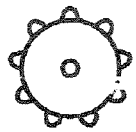
Figure 10:
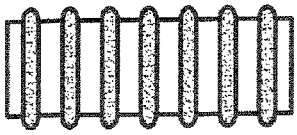
Figure 11:
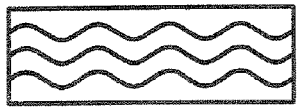

Likewise, the outer surface of the rotating component may be homogeneous or, as can be seen in FIGS. 7 to 11, provided with spikes (FIG. 7), bristles or axial lamellae, or with ridges, spikes or teeth (FIGS. 8 and 9). It is also possible to equip the peripheral surface of the rotating component with annular (FIG. 10) or axial (FIG. 11) raised sections, regularly distributed over the periphery of the rotating component, the spacing, height, angle and distribution of the raised sections around the rotating component possibly varying depending on the applications.

The rotating component may also be produced, for example, from a rigid plastic, a flexible plastic, a rigid porous material, a foam, etc. According to another variation, a flocking can be provided on the rotating component, by producing a soft coating by spraying and bonding of an entanglement of fibers agglomerated with a binder. Such a flocking can be provided on applicators having various external shapes.

Further by way of example, the rotating component can be produced from several materials, for example from two materials, especially a rigid plastic that is two-shot injection molded so as to produce a rigid central core and a more flexible outer coating, for example made from an elastomer.

Figure 12:
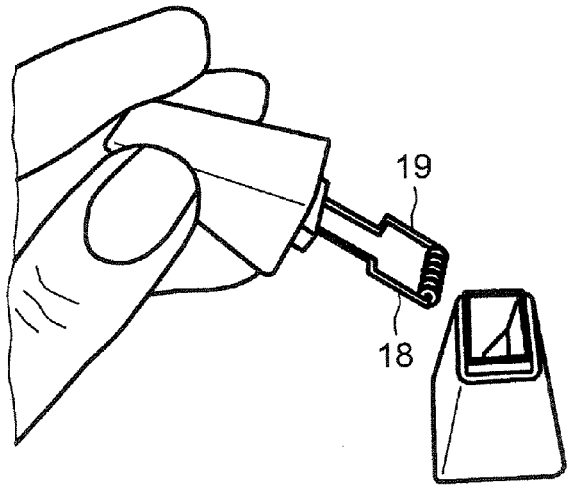
FIG. 12 is another view of the device according to an example of the invention in the process of being used.

According to a feature of the examples described above, because wiping of the applicator is carried out by rolling the applicator against a wall extending into the container, when the applicator is completely removed from the container (FIG. 12), the applicator is loaded with an optimal or more optimal dose of product, enabling any overloading to be avoided or minimized.

Figure 13:
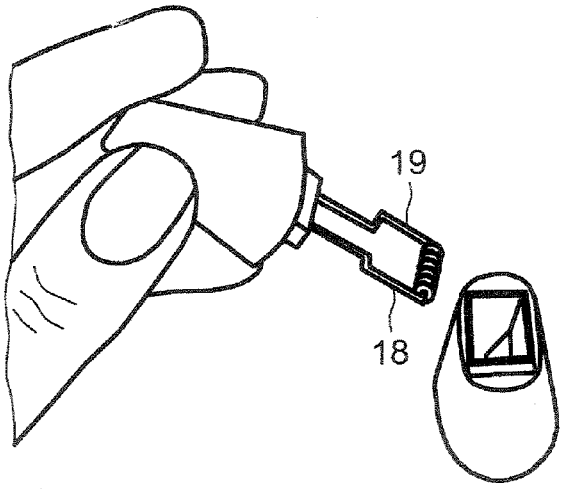
FIGS. 13 to 15 illustrate other examples of embodiments of a device for packaging and applying a cosmetic or care product according to the invention.
Figure 14:
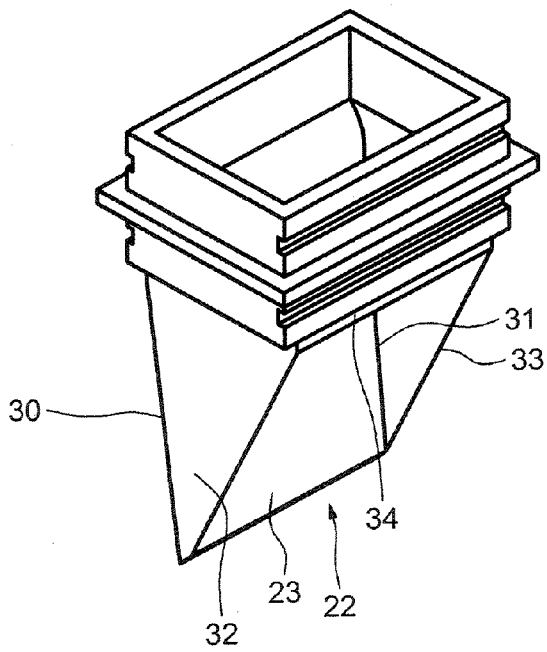

However, it should also be noted that the invention is not limited to the examples described. For example, in the previously described embodiment examples, the container and the lid have a rectangular cross section. The container may also have other shapes, for example a shape in which the lid and the container have an oval cross section (FIG. 13). In addition, in the previously described embodiment, in particular with reference to FIGS. 2 and 3, the wiping member is in the form of a single wall. However, it is also possible, as illustrated in FIG. 14, to equip the wiping member 22 with two transverse stiffening walls 32 and 33 extending perpendicular to the wall 23 from its two longitudinal edges. The two transverse walls 32 and 33 may then have a regularly decreasing height and be connected at their end opposite the wall 23, by a lateral edge 34 of reduced height in order to provide the wiping member with increased rigidity.

Figure 15:
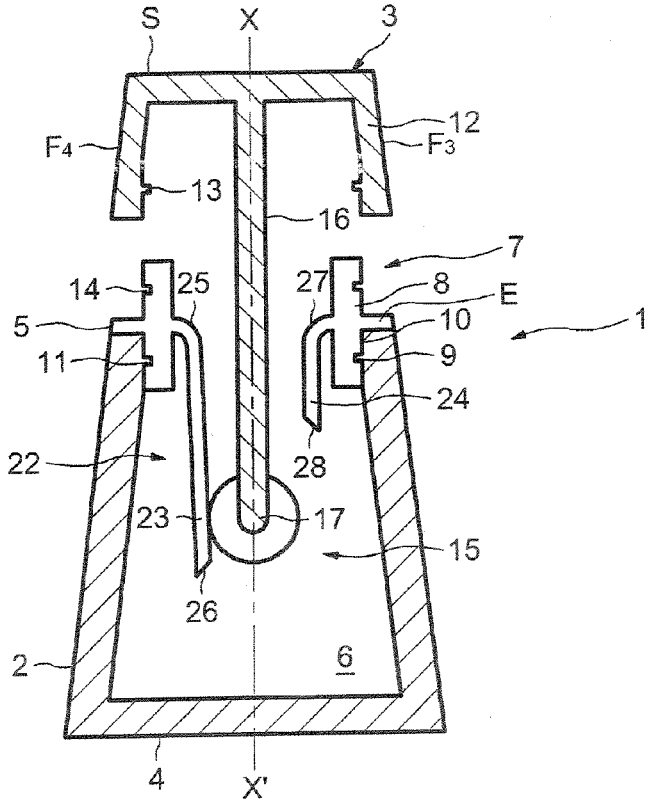

Another example of an embodiment of a device for packaging and applying according to the invention will now be described with reference to FIG. 15. In this FIG. 15, the components identical to those described previously are denoted by the same numerical references. As is shown in FIG. 15, in this embodiment, the wiping member includes, on the one hand, a first wiping surface 23 which makes it possible to carry out wiping of the applicator 15 by rotation, and a second wiping surface 24 for wiping the applicator.

In the illustrated example, the first wiping surface 23 is produced in the form of a tail that extends from the body 8 of the collar 7, approximately parallel to the axis X-X' of the container 2 but while slightly converging towards this axis. It is, to that end, provided with a proximal end 25, via which it extends from the collar 7, having a curved shape and with a chamfered free distal end 26. The second wiping surface 24 is also produced in the form of a tail that extends from the median part of the body 8 of the collar 7. It also includes a curved proximal end 27, via which it extends from the body 8, which extends through a rectilinear portion to a distal end 28. This end 28 is also chamfered so as to avoid forming a stop that is capable of blocking the removal of the applicator 15.

The length of the tail 24 is much shorter than that of the first wall 23 so that the free end 28 of the second wall 24 is set back relative to the free end 26 of the first wall 23.

In other words, the second wiping surface 24 is only active when the applicator 15 reaches the neck 7 or close to the neck and is on the point of being removed from the container.

It is also out of line with the axis X-X' of the container so that the distance between the two wiping surfaces 23 and 24 approximately corresponds to the external diameter of the applicator 15.

In the example of FIG. 15, when the applicator 15 is removed from the container, the wiping is started as soon as the applicator 15 reaches the free end 26 of the first wiping surface 23. The wiping is then first carried out by rolling the rotating component against this first wiping surface. Draining of the excess product may be improved by providing orifices in the tail 23 in order to facilitate the return of the product to the bottom of the container. However, it is also possible to provide such orifices in the second wiping surface 24.

When the applicator 15 reaches the second wiping surface 24, the wiping via rolling the applicator against the first tail 23 is combined with a wiping by pressing against the second tail 24, that is to say by rubbing the applicator against the second surface.

Depending on the stress exerted by each of the tails 23 and 24 on the applicator 15, that is to say depending on the distance separating each tail 23 or 24 from the axis X-X', it is possible, in this area, to provide pressing of the applicator 15 by rubbing against the two tails 23 and 24, simultaneously, or to combine wiping by rotation against one of the two tails combined with pressing by rubbing against the other tail.

The tails 23 and 24 can be modeled or shaped depending on the type of wiping desired.

It should be noted that, in the embodiment example represented, the collar 7 is assembled by snap fastening onto the upper end 5 of the body of the container. To that end, the outer surface of the lower part of the body 8 is provided with a peripheral groove 9 whereas the internal peripheral surface of the upper end 5 of the body of the container includes a straight edge 10 in which an internal peripheral ridge or edge 11 is made, which snap-fastens into the groove 9 of the collar body. Of course, it would also be possible, as a variation, to make the groove in the straight edge 10 of the container and to put the peripheral ridge in the collar 7.

In addition, according to the embodiment example from FIG. 15, the lid is fixed on the attached collar. To that end, the internal wall of the skirt of the lid 12 is provided with an internal peripheral rib 13 whereas the external peripheral surface of the upper part of the body 8 of the collar 7 is provided with a peripheral groove 14 in which, on assembly, the rib 13 of the lid 12 is snap-fastened. Of course, provision could also be made for the protruding rib 13 to be on the collar 7 and the groove 14 to be in the lid.

It should be noted that these assembly variations, according to which the lid is snap-fastened onto the collar and the collar is snap-fastened onto the neck may also be utilized in the embodiment described previously with reference to FIG. 2. Likewise, the various applicator shapes that can be utilized in the device of FIG. 2 can also be used within the scope of the device of FIG. 15.

In addition, in different embodiments, various shapes can be used for the container 2, that thus can have a cylindrical shape with a circular or square section.

The wiping member 22 may also have any different shape. It can thus, for example, referring to FIG. 14, have a constant height on its whole periphery or, in other words, have a transverse lower opening, the wiping member having, in this case a square, circular or rectangular cylindrical shape, depending on the shape of the applicator. In such a case, the applicator may in addition have a reduced radius. The wiping member may also in addition be made with a porous or perforated material.

Figure 16:
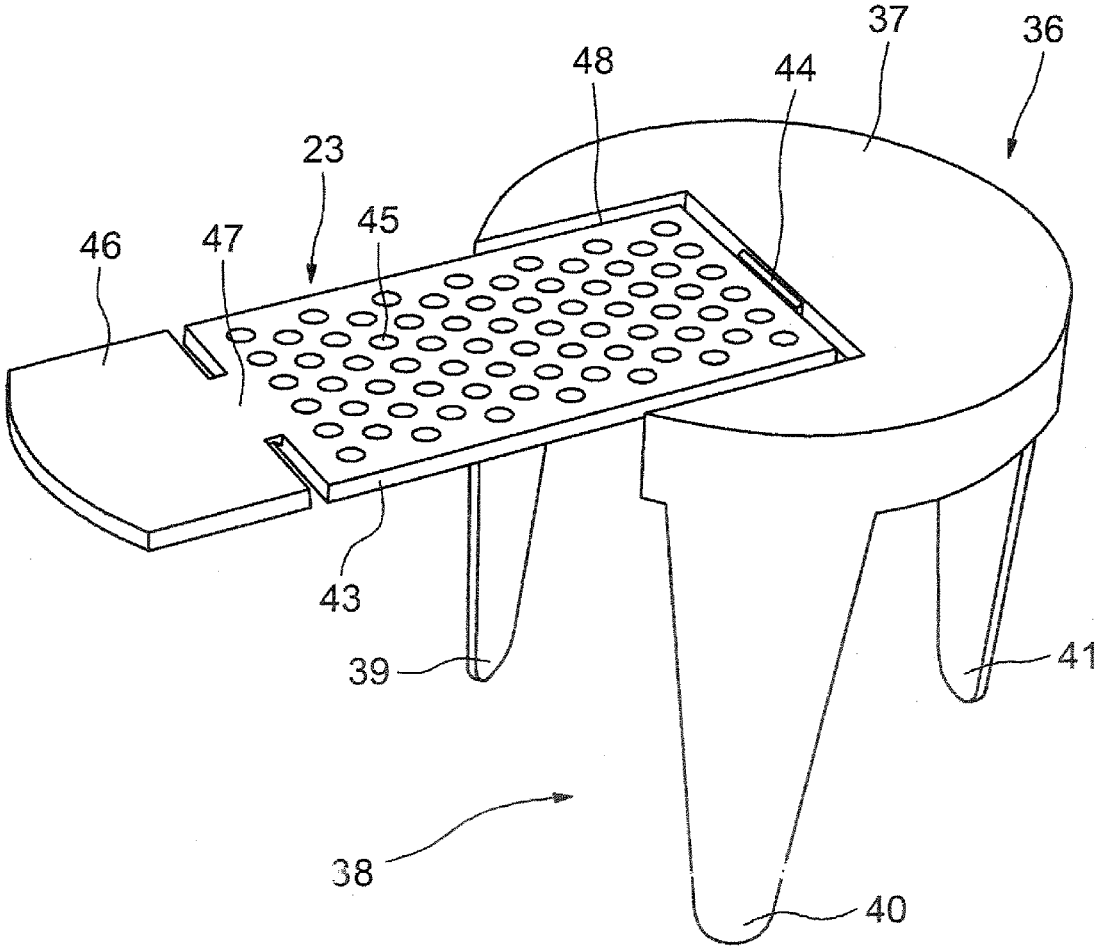
FIGS. 16 and 17 again illustrate another example of an embodiment of a device for packaging and applying a cosmetic or care product according to the invention.
Figure 17:
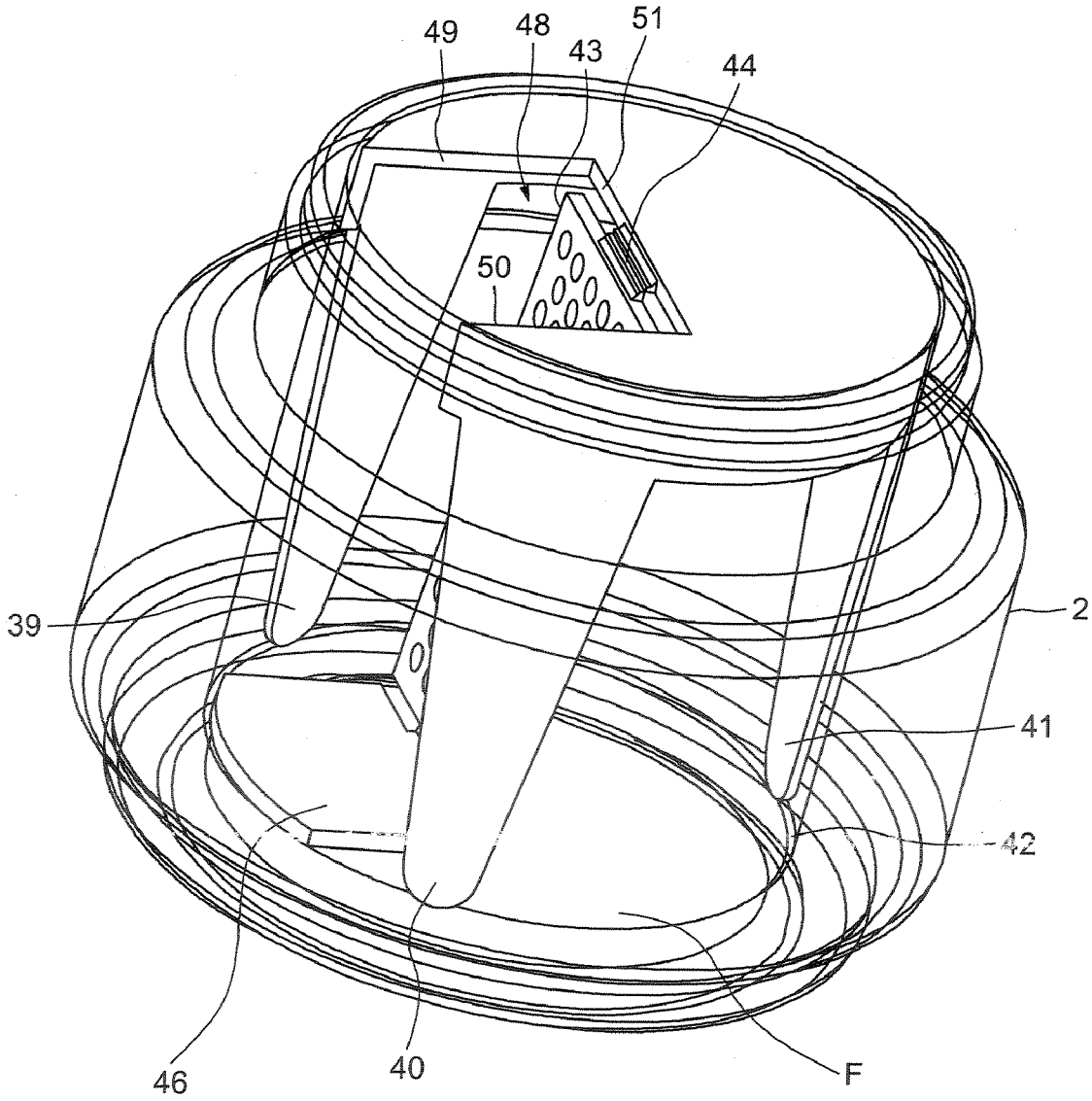

Another embodiment of a device for packaging and applying a product according to an example of the invention and, in particular, the wiping member, will also be described with reference to FIGS. 16 and 17. In this embodiment, the wiping member, which is intended to extend in an overall direction parallel to the general axis of the container or in a slightly inclined manner, as illustrated in FIG. 17, extends from a support 36 which is placed in the container, at a distance from the bottom.

The support 36 is, for example, produced in the form of a plate 37 onto which the wiping surface 23 is articulated. This plate 37 extends transversely in the container level with the neck 5, for example, in the vicinity of the open end of the container. The arrangement of this example includes a base 38 formed, for example, from a group of three feet 39, 40 and 41, regularly distributed over the periphery of the plate 37 and having a width that regularly decreases in the direction of their free end, via which they rest against the bottom of the container. For example, as can be seen in FIG. 17, the free ends of the feet have a rounded shape and each rests on an annular shoulder 42 provided in the bottom of the container.

With this arrangement, and by choosing suitable dimensions for the support relative to the internal volume of the container, a free rotation of the support and of the wiping surface 23 that it bears is obtained.

The wiping surface 23 include a first portion 43 connected, via a first articulation 44, to the plate 37. Preferably, this first portion 43 is provided with perforations, such as 45. The wiping surface 23 also includes a second portion 46 connected to the first portion 45 via a second articulation 47.

The assembly formed by the support 36 and the wiping surface, including the first and second portions, may be produced by molding a plastic, with the articulations 44 and 47 possibly being formed by a thin hinge.

In order to allow access to the wiping surface, the plate 37 includes, for example, a rectangular cutout 48 that makes the first perforated portion 43 accessible from the outside.

For example, as shown, the cutout is designed so as to have two side edges 49 and 50 and a longitudinal edge 51 placed along the general axis of the container or slightly out of line with the latter, with the first articulation being provided at this longitudinal edge 51.

During use, as can be seen in FIG. 17, when the support and the wiping surface 23 are inserted into the container, so that the support 36 rests against the bottom via its feet 39, 40 and 41, the wiping surface 23 extends, for example, in a slightly inclined direction relative to the general axis of the container and rests against the bottom F via its second portion 46. With this arrangement, the inclination of the wiping surface in the container and also the insertion of the wiping member in the container are well adjusted or positioned.

In addition, the wiping member is free to rotate in the container so that, when the capping member and also the rotating component that it bears are screwed on, the first perforated portion can turn together with the rotating component, which enables the formula contained in the container to be homogenized or mixed.

It should be noted that the embodiment which has just been described with reference to FIGS. 16 and 17 may be used together with the various applicator shapes, for example as previously discussed with reference to FIGS. 4 to 11.

Finally, it should be noted that the invention which has just been described makes it possible to produce a device for packaging and applying a product using an applicator having a rotating component that is capable of being suitably wiped before application. In addition, by using a relatively reduced number of parts in so far as the container is concerned, the capping member and the collar may each be produced, for example, from a single part.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for packaging and applying a cosmetic or care product, comprising:

a container for storing the product, the container including a closed end and an open end forming a neck;

a product applicator comprising a rotating component capable of being inserted into the container in order to be loaded with the product and capable of applying the product removed onto an application surface;

a member for capping the container that holds the applicator, said member forming a lid provided with the applicator; and an applicator wiping member;

wherein the wiping member comprises a wiping wall extending from the neck in the direction of the closed end against which the rotating component rolls along when it is moved in the container.

2. A device according to claim 1, wherein the wiping wall extends in an overall direction parallel to a general axis (X-X') of the container.

3. A device according to claim 1, further including means for stiffening the wall.

4. A device according to claim 3, wherein the stiffening means includes two transverse walls extending respectively from two longitudinal edges of the wiping wall, perpendicular to said wall.

5. A device according to claim 4, wherein the transverse walls have a height that decreases regularly away from the wiping wall.

6. A device according to claim 5, wherein the transverse walls are connected on a side of the wiping wall opposite to a side which contacts the rotating component.

7. A device according to claim 1, wherein the wiping wall is equipped with perforations.

8. A device according to claim 1, further including a collar that holds the wiping member, wherein the collar is mounted to the open end of the container.

9. A device according to claim 8, wherein the collar is equipped with snap-fastening means that interact with complementary snap-fastening means of the container body.

10. A device according to claim 1, wherein the capping member is provided with snap-fastening means that interact with complementary snap-fastening means of a neck of the container.

11. A device according to claim 1, wherein the wiping member comprises a support placed at a distance from a bottom of the container from which the wiping wall extends.

12. A device according to claim 11, wherein the support comprises a base resting against the bottom of the container.

13. A device according to claim 12, wherein the base comprises three feet.

14. A device according to claim 11, wherein the support comprises a plate which extends transversely in the container and which comprises a cutout for access to the wiping wall.

15. A device according to claim 14, wherein the wiping wall is articulated to the plate and rests against the bottom of the container.

16. A device according to claim 15, wherein the wiping wall surface comprises a first portion connected to the transverse plate via a first articulation and a second portion connected to the first portion via a second articulation and by way of which said wiping wall rests against the bottom of the container.

17. A device according to claim 16, wherein the first portion is perforated.

18. A device according to claim 1, wherein the rotating component is rotationally mounted on a mount held by the capping member, for rotation about a rotational axis that is perpendicular to a general axis of the container when the product applicator is inserted in the container.

19. A device according to claim 1, wherein the rotating component comprises a raised outer surface.

20. A device according to claim 1, wherein a neck of the container includes a transverse cross section in the shape of a parallelogram.

21. A method for applying a cosmetic or care product, comprising:

immersing an applicator comprising a rotating component into a container filled with the product to be applied, the container including a closed end and an open end forming a neck;

extracting the applicator from the container while wiping it; and applying the product onto an application surface using the wiped applicator, wherein the wiping of the applicator is carried out by rotation of the rotating component against a wiping surface extending into the container from the neck in a direction of the closed end, wherein a member for capping the container holds the applicator, the member forming a lid provided with the applicator.

22. A method according to claim 21, wherein the rotation of the rotating component against the wiping surface is carried out about a rotational axis that is perpendicular to a general axis (X-X') of the container.

* * * * *